US006669081B2

(12) United States Patent
Hearne et al.

(10) Patent No.: US 6,669,081 B2
(45) Date of Patent: Dec. 30, 2003

(54) SHIPPING AND DISPLAY CASE

(75) Inventors: Daryl Hearne, Wisconsin Rapids, WI (US); Jason E. Wardour, Wisconsin Rapids, WI (US)

(73) Assignee: Stone Container Corp., Chicago, IL (US)

( * ) Notice: Subject to any disclaimer, the term of this patent is extended or adjusted under 35 U.S.C. 154(b) by 0 days.

(21) Appl. No.: 10/083,308

(22) Filed: Feb. 26, 2002

(65) Prior Publication Data

US 2003/0160091 A1 Aug. 28, 2003

(51) Int. Cl.[7] ..... B65D 25/04

(52) U.S. Cl. ..... 229/120.18; 229/120.13; 229/164

(58) Field of Search ..... 229/120.18, 120.14, 229/120.15, 120.13, 164

(56) References Cited

U.S. PATENT DOCUMENTS

| | | | | |
|---|---|---|---|---|
| 2,660,361 A | * | 11/1953 | Tyrseck | 229/120.13 |
| 2,747,767 A | * | 5/1956 | Bergstein | 229/120.15 |
| 4,105,154 A | * | 8/1978 | Meyers et al. | 229/120.18 X |
| 4,197,979 A | * | 4/1980 | Dutcher | 229/120.17 |
| 5,538,130 A | * | 7/1996 | Harrelson | 206/162 |
| 5,657,925 A | * | 8/1997 | Norris | 229/120.13 |
| 6,033,115 A | * | 3/2000 | Zeiler | 229/67.1 X |

* cited by examiner

*Primary Examiner*—Tri M. Mai
(74) *Attorney, Agent, or Firm*—Greenberg Traurig, P.C.

(57) ABSTRACT

A shipping and display case for transporting product to a display and vending location, comprising a single blank, having width, length and bottom panels therein, and further having internal divider panels formed thereon. Upon folding and gluing of the case, and subsequent articulation into a raised state, two internal dividers are created that also provide structural support for the case in stacking circumstances.

15 Claims, 8 Drawing Sheets

SHIPPING AND DISPLAY CASE

BACKGROUND OF THE INVENTION

1. Field of the Invention

The present invention relates to shipping cases, in particular shipping cases that are fabricated at least in part from paper, paperboard and/or corrugated paperboard material. The present invention also relates to such cases that include shipping configurations and display configurations.

2. Prior Art

In stores which deal with dry goods that are sold in their own individual containers, such as grocery or warehouse stores, a traditional method for placing the goods on display would be for store personnel to open the shipping cases in which the goods have been shipped from the supplier, individually place each item on the shelf, and arrange them neatly for presentation. Such cases were often structures dedicated solely to a shipping function, and when opened, were either destroyed or resulted in an open-topped case not well suited for merchandising functions.

However, this process of individual removal of goods from a shipping and display case, and placement on shelves, is relatively costly to the store in terms of personnel effort, time, wages, etc. Therefore, it has become desirable to reduce costs in converting goods packaged for shipping into a suitable format for display and shopping.

This has resulted in the development of a variety of cases that are configured to be convertible from a shipping configuration into a display configuration, which permits the converted case to be placed directly upon a shelf, or floor display, without having to remove the individual product items from the case. Often, this is accomplished by providing the case with removable or already cut out portions of the case that create apertures through which customers may then help themselves to the products within the converted case.

Such shipping and display cases represent a challenge in that they must be readily convertible into or already are in a form presentable to customers, while at the same time maintaining certain shipping performance characteristics, suitable for the shipment of non-self-supporting or even fragile products.

However, such prior art shipping and display cases often are either lacking in the necessary shipping performance characteristics or may have overly complex, often multipiece constructions.

It is accordingly desirable to provide a shipping and display case that is provided with internal dividers for increased strength, durability and control over the product.

It is further desirable to provide a shipping and display case that is advantageously configured for improved display and "shopability" for the consumer.

These and other desirable characteristics of the present invention will become apparent in view of the present specification and drawings.

SUMMARY OF THE INVENTION

The present invention comprises, in part, a shipping and display case for transporting and displaying product, which is operably configured to be articulated between a collapsed configuration and a shipping and display configuration.

The shipping and display case comprise first and second length wall panels; and first and second width wall panels, foldably connected to the first and second length wall panels, respectively. The first and second length wall panels are configured to be substantially perpendicular to the first and second width wall panels, when the shipping and display case is in its shipping and display configuration. Respective ones of the first and second length wall panels are configured to be substantially parallel to respective ones of the first and second width wall panels, when the shipping and display case is in its collapsed configuration.

A divider support panel is operably connected to one of the first and second length wall panels and first and second width wall panels, the divider support panel being operably positioned substantially between said one of said first and second length wall panels and first and second width wall panels. At least one divider panel is foldably connected at a first end to the divider support panel, and foldably connected at a second end to the other of the first and second length wall panels and first and second width wall panels, the at least one divider panel being operably configured to extend substantially perpendicular to respective ones of the first and second length wall panels and first and second width wall panels, when the shipping and display case is in its shipping and display configuration.

At least one bottom flap is operably connected to one of the first and second length wall panels and first and second width wall panels, and operably configured to be positioned substantially perpendicular to the first and second length wall panels and first and second width wall panels, when the shipping and display case is in its shipping and display configuration.

In a preferred embodiment of the invention, the divider support panel is foldably connected to a top edge of said one of the first and second length wall panels, and is foldably positioned in juxtaposed, overlying relation to an inside surface of said one of said first and second length wall panels. In an alternative embodiment of the invention, the divider support panel is foldably connected to a top edge of said one of the first and second width wall panels, and is foldably positioned in juxtaposed, overlying relation to an inside surface of said one of said first and second width wall panels.

Preferably, the at least one divider panel may comprise two divider panels, each divider panel foldably connected at a first end to the divider support panel, and foldably connected at a second end to the other of the first and second length wall panels and first and second width wall panels, the two divider panels being operably configured to extend substantially perpendicular between one of a set of first and second length wall panels and first and second width wall panels, when the shipping and display case is in its shipping and display configuration.

Preferably, at least one access aperture is disposed in at least one of the first and second length wall panels and first and second width wall panels.

In a preferred embodiment of the invention, the height of the at least one divider panel is approximately equal to the height of the first and second length wall panels and the height of the first and second width wall panels.

In preferred embodiment of the invention, the first and second length wall panels, first and second width wall panels, divider support panel, at least one divider panel, and at least one bottom flap are all monolithically formed from a single blank of case material. The single blank of case material may be fabricated from at least one of the following materials: paper, paperboard, corrugated paperboard.

In an alternative embodiment of the invention, a divider attachment flap is foldably connected to said second end of said at least one divider panel.

The present invention also comprises, in part, a blank for forming a shipping and display case for transporting and displaying product. The blank comprises a first length wall panel; first and second width wall panels each of which is foldably connected to an opposite end edge region of the first length wall panel, respectively; and a second length wall panel, foldably connected to an end edge region of one of the first and second width wall panels opposite the end edge region of said first and second width wall panel attached to said first length wall panel.

A divider support panel is foldably connected to a top edge region of the first length wall panel; and at least one divider panel is foldably connected to an end edge region of the divider support panel. At least one bottom flap is foldably connected to a bottom edge region of one of the first and second length wall panels and first and second width wall panels. In a preferred embodiment of the invention, the blank is monolithically formed from a single blank of case material. Preferably, the single blank of case material is fabricated from at least one of the following materials: paper, paperboard, corrugated paperboard.

The invention also comprises in part a blank for forming a shipping and display case for transporting and displaying product. The blank comprises a first length wall panel; first and second width wall panels each of which is foldably connected to an opposite end edge region of the first length wall panel, respectively; and a second length wall panel, foldably connected to an end edge region of one of the first and second width wall panels opposite the end edge region of said first and second width wall panel attached to said first length wall panel. A divider support panel is foldably connected to a top edge region of the first width wall panel. At least one divider panel is foldably connected to an end edge region of the divider support panel. At least one bottom flap is foldably connected to a bottom edge region of one of the first and second length wall panels and first and second width wall panels. In a preferred embodiment of the invention, the blank is monolithically formed from a single blank of case material. Preferably, the single blank of case material is fabricated from at least one of the following materials: paper, paperboard, corrugated paperboard.

BRIEF DESCRIPTION OF THE DRAWINGS

FIG. 4*a* is a perspective view of a shipping and display container according to the blank of FIG. 4.

DETAILED DESCRIPTION OF THE DRAWINGS

Figure 1:
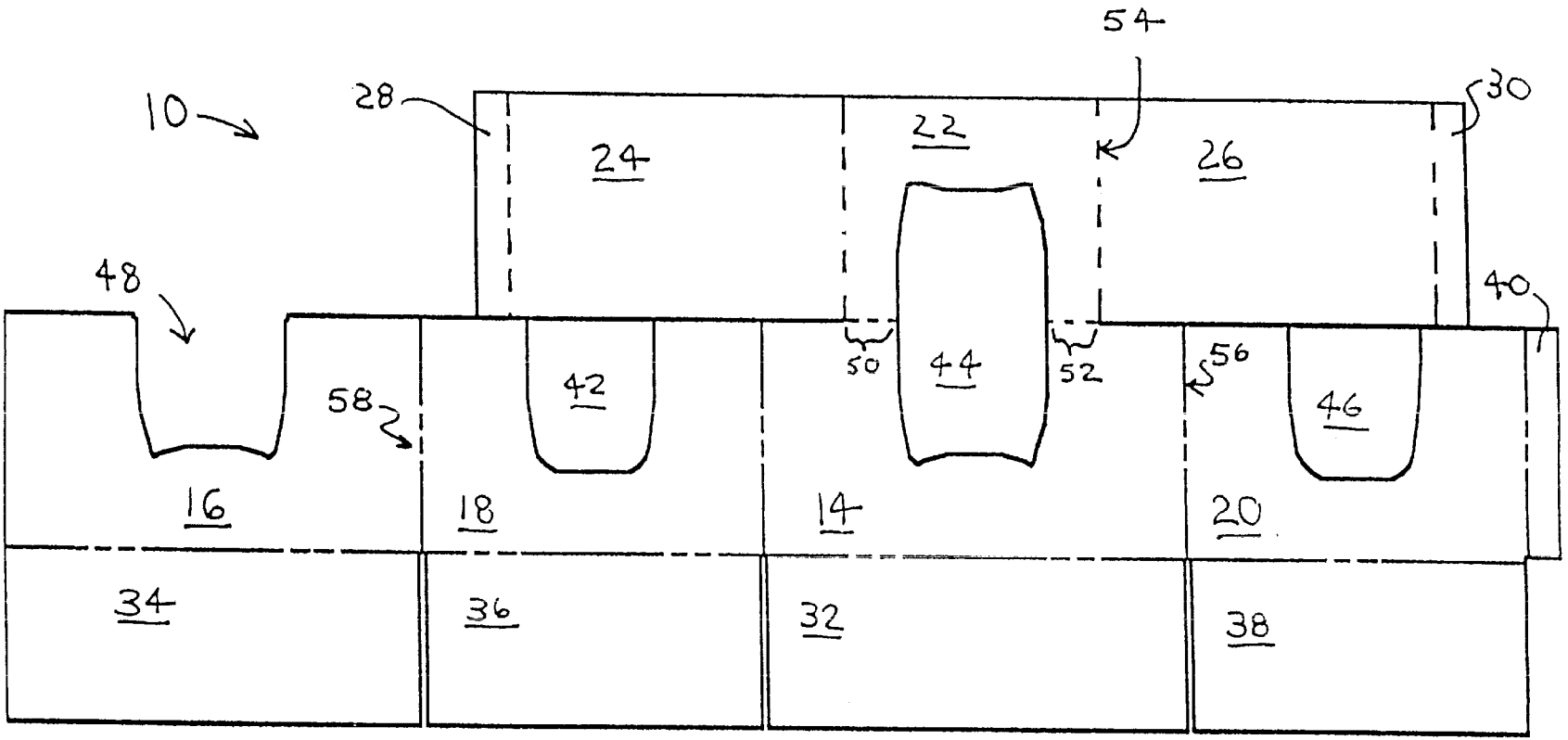
FIG. 1 is a blank for a shipping and display case according to a preferred embodiment of the invention.

While this invention is susceptible of embodiment in many different forms, there is shown in the drawings and will be described herein in detail, a specific embodiment, with the understanding that the present invention is to be considered as an exemplification of the principles of the invention and is not intended to limit the invention to the embodiment illustrated.

FIG. 1 shows a blank 10 for forming a shipping and display case 12 (FIG. 3) according to a preferred embodiment of the invention. In FIG. 1 and in the other blank drawings herein, unless otherwise stated, the usual drawing conventions regarding the illustration of carton blanks are followed, in that solid lines on the interior of the blank represent through-cuts or apertures, and dashed or broken lines represent folds, creases or other lines of weakness.

In a preferred embodiment of the invention, blank 10 is fabricated from corrugated paperboard material. One preferred material is EB doublewall material, as is referred to by those of ordinary skill in the art of fabricating corrugated paperboard cases, although other flute profiles may be employed, using any singlewall flute profile (e.g., A, C, B, E, F, G, K, L, M, N, S), or their various doublewall permutations (e.g., AC, BC, EC, EB, AB, CB, LE, BN, etc.). Other materials may be employed, as desired or required by the needs of a particular application of the design.

Figure 3:
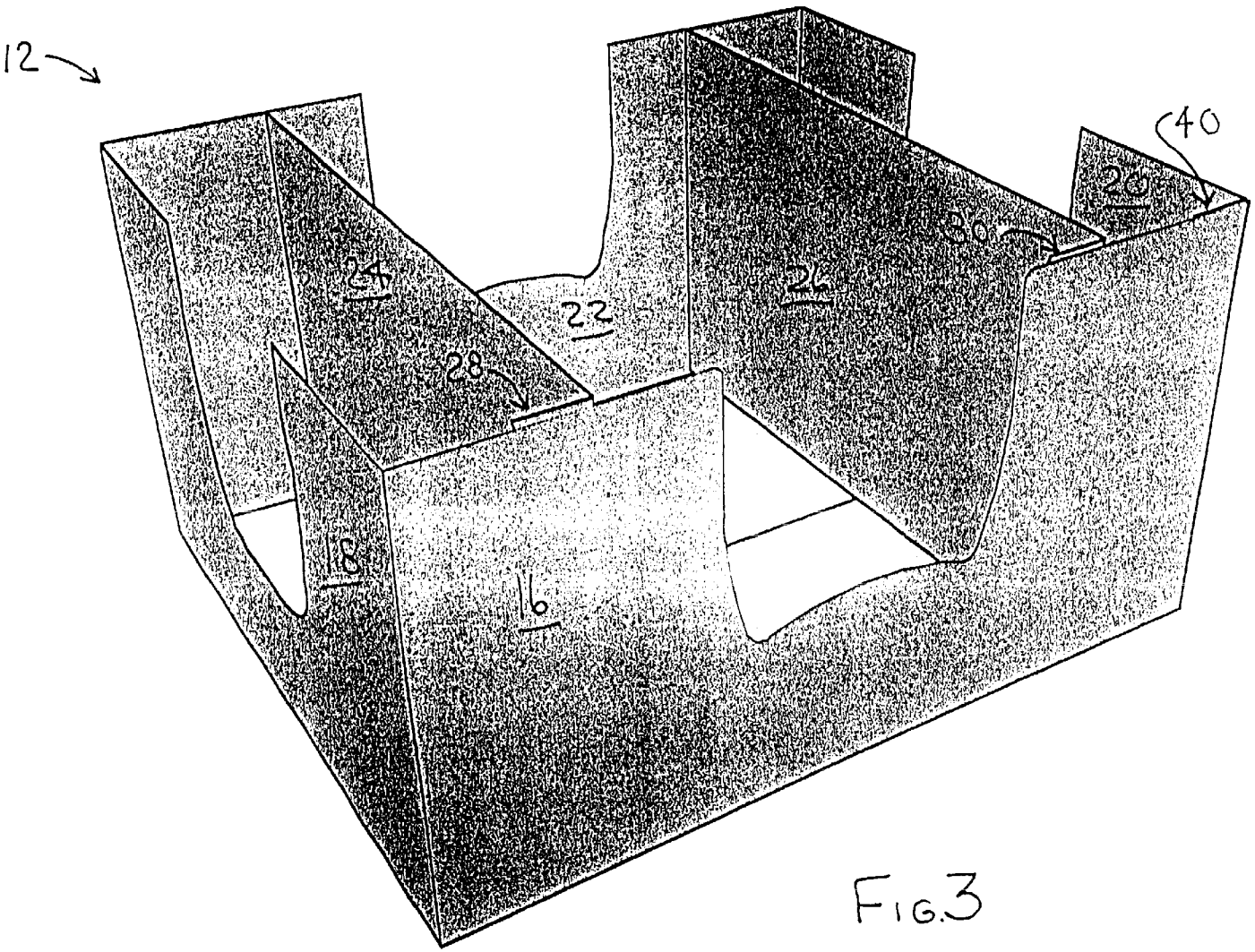
FIG. 3 is a perspective view of a fully set-up shipping and display case according to the embodiment of FIGS. 1–2.

Blank 10 includes length wall panels 14 and 16; width wall panels 18 and 20; divider support panel 22; divider panels 24 and 26; divider attachment glue flaps 28 and 30; length bottom flaps 32 and 34; width bottom flaps 36 and 38; and case joint glue flap 40. Blank 10 also includes apertures 42, 44 and 46, and cut 48, which form, in the finished case 12, as shown in FIG. 3, openings which facilitate side removal of product from within case 12, without the customer having to reach in from above.

Figure 2:
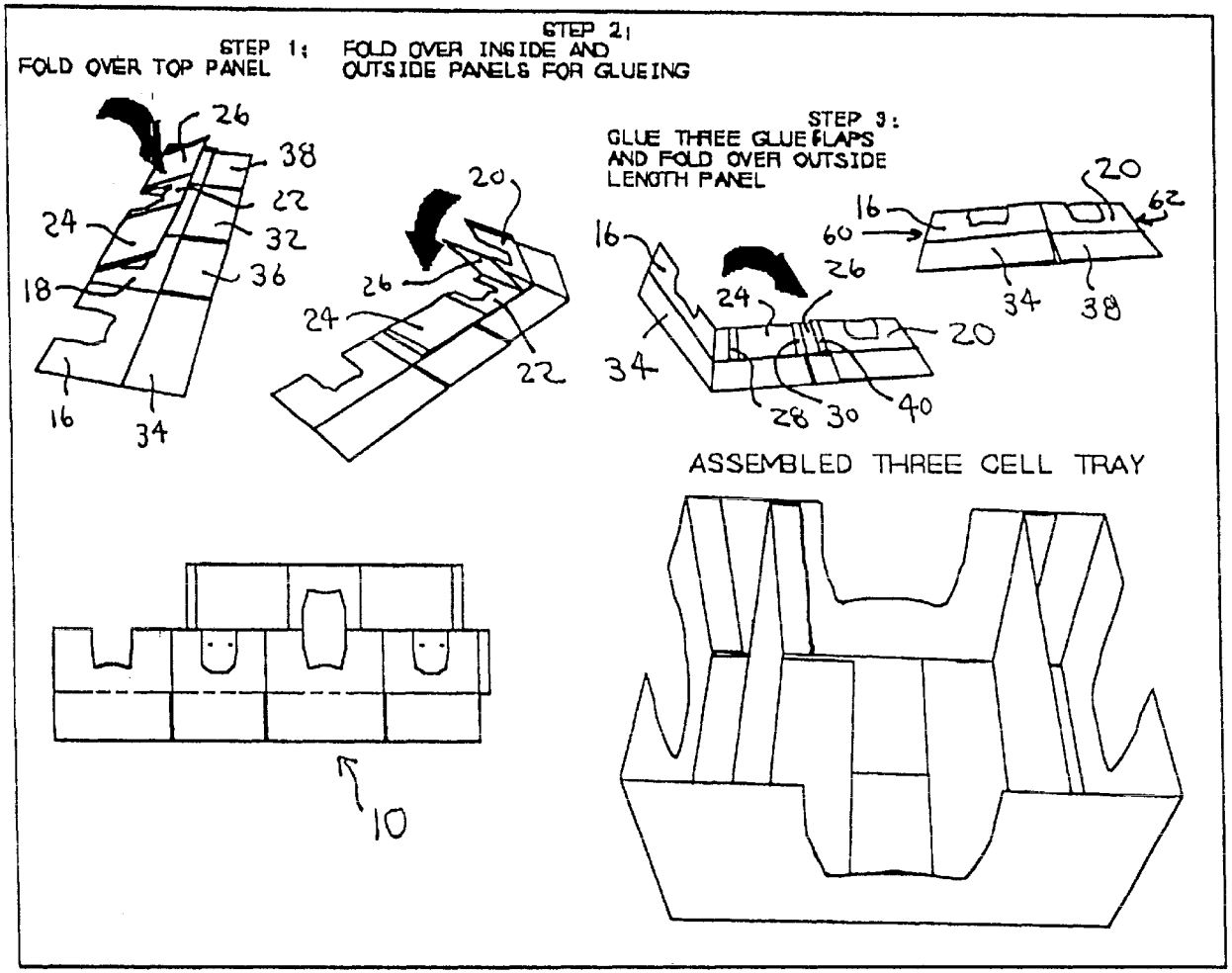
FIG. 2 illustrates the steps in the articulation and set-up of the shipping and display case according to the embodiment of FIG. 1.

To form shipping and display case 12, first, divider support panel 22 is folded about fold lines 50, 52, to overlie length wall panel 14. Simultaneously, divider panels 24, 26 are brought into overlying positions over length wall panel 14, and width wall panels 18 and 20, respectively. This step is shown in the upper left of FIG. 2 as "Step 1". Fold lines 50, 52 each may be single scores permitting folding through 180°, or two parallel score lines folding through 90° each.

Next, divider panel 26 is folded about fold line 54, to overlie divider support panel 22 and divider panel 24; and width wall panel 20 is folded about fold line 56, to overlie divider panel 26. This step is shown in the upper left center of FIG. 2 as "Step 2".

Any suitable adhesive material is then applied only to the exposed surfaces of divider attachment glue flaps 28 and 30 and case joint glue flap 40. Length wall panel 16 is then folded about fold line 58, to overlie (from left to right) width wall panel 18, divider attachment glue flap 28, a portion of divider panel 24, divider attachment glue flap 30, a portion of divider panel 26, and case joint flue flap 40. See "Step 3", upper right of FIG. 2. Alternatively, adhesive could be applied to the surface(s) that the panels 28, 30 and 40 would overlie when folded as described herein.

Once the adhesive has set, case 12 may be erected by any suitable means, such as by pushing edges 60, 62 toward one another (see upper right of FIG. 2), and/or by pulling length wall panels 14 and 16 away from one another. To close the bottom of case 12, in one method, width bottom panels 36, 38 are folded up against the bottoms of divider panels 18 and 20, adhesive is applied, and length bottom panels 32 and 34 are folded up against width bottom panels 36, 38. Alternatively, the sequence of folding of the bottom panels may be varied, and the bottom panels may be affixed in place by any other suitable means, such as staples or tape, or even left unaffixed, if the case is going to be transported on a pallet all the way to its ultimate display destination. The final shipping and display configuration of case 12 is shown in the lower right of FIG. 2.

While the terms "length" and "width" are used herein with respect to specifically identified structures, it is to be understood that as adjectives these terms are interchangeable, in that no specific numerical value or other relationship should be presumed from the terms "length" and "width". For example, while divider support panel 22 is in a preferred and illustrated embodiment, emanating from and/or connected to one of the "length" wall panels, it may in an alternative embodiment, emanate from or be connected to a "width" wall panel.

Once case 12 has been filled with product, for shipping it may be provided with a simple conventional rectangular case cover; simply palletized and wrapped with plastic, or covered using any suitable method.

While in the embodiments illustrated, there are no apertures or die cuts formed in the divider panels, it is to be understood that if desired, suitable product access apertures may be provided in the divider panels to provide even further side access through the case. While the blank shown in relation to the illustrated preferred embodiment of the invention has a particular "left-to-right" orientation, it is to be understood that the blank may have a reversed configuration, with respect to the ordering of the panels and flaps, readily understood by one of ordinary skill in the art having the present disclosure before them, without departing from the scope of the invention.

The shipping and display case of the present invention is believed to have, among other advantageous features, that characteristic of being a single piece, "one pass", multiple glue joint case, in which the partitions are created internally for structural support (in the preferred embodiment, the divider panels are the same height as the width and length wall panels), as well as creating cells for product.

The die cut apertures offer ease of product access. Any one or more (or all) of the die cut apertures could be eliminated or their contours changed, as dictated by the needs of a particular customer. By being a one-piece design, the case of the present invention helps reduce setup time otherwise lost in the folding and insertion of separate partition structures.

Figure 4:
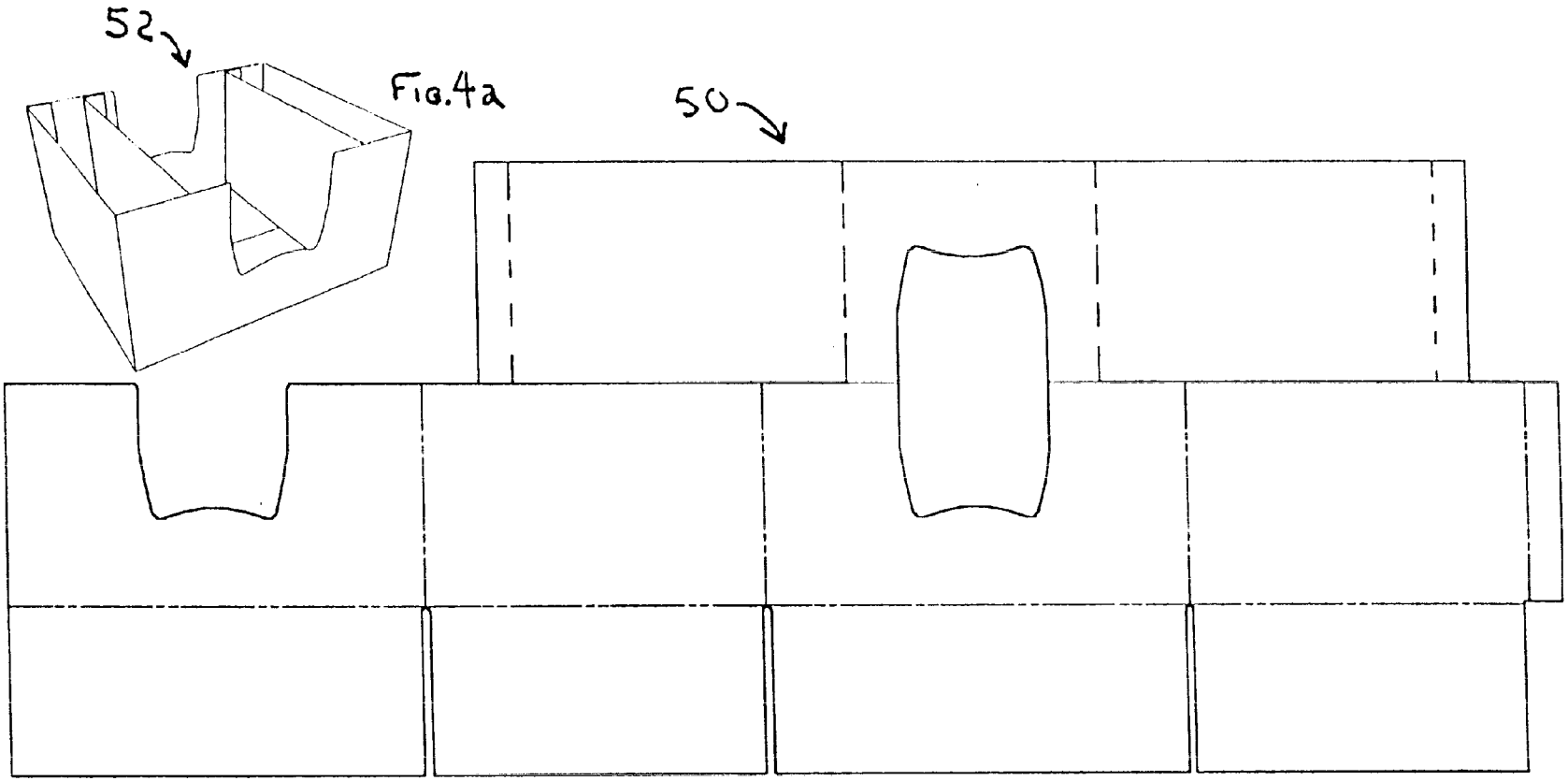
FIG. 4 is a plan view of a blank for a shipping and display container according to an alternative embodiment of the invention.

For example, FIG. 4 is a plan view of a blank 50 for a shipping and display container 52 according to an alternative embodiment of the invention. FIG. 4*a* is a perspective view of shipping and display container 52 according to the blank of FIG. 4, which has only two side apertures.

Figures 5, 5A:
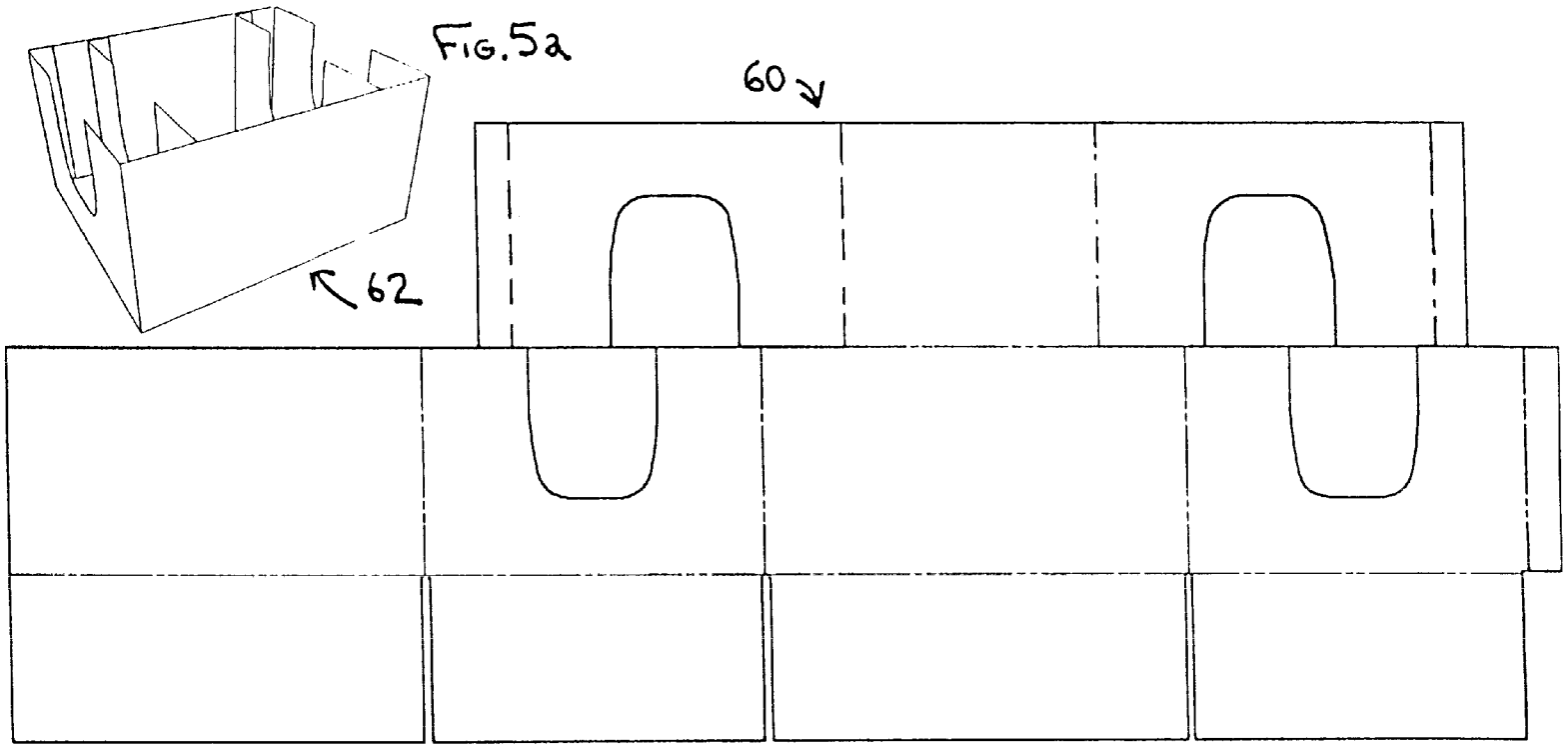
FIG. 5 is a plan view of a blank for a shipping and display container according to an alternative embodiment of the invention.
FIG. 5*a* is a perspective view of a shipping and display container according to the blank of FIG. 5.

FIG. 5 is a plan view of a blank 60 for shipping and display container 62 according to an alternative embodiment of the invention. FIG. 5*a* is a perspective view of shipping and display container 62 according to the blank 60 of FIG. 5, having access apertures through the end walls and the internal dividers.

Figures 6, 6A:
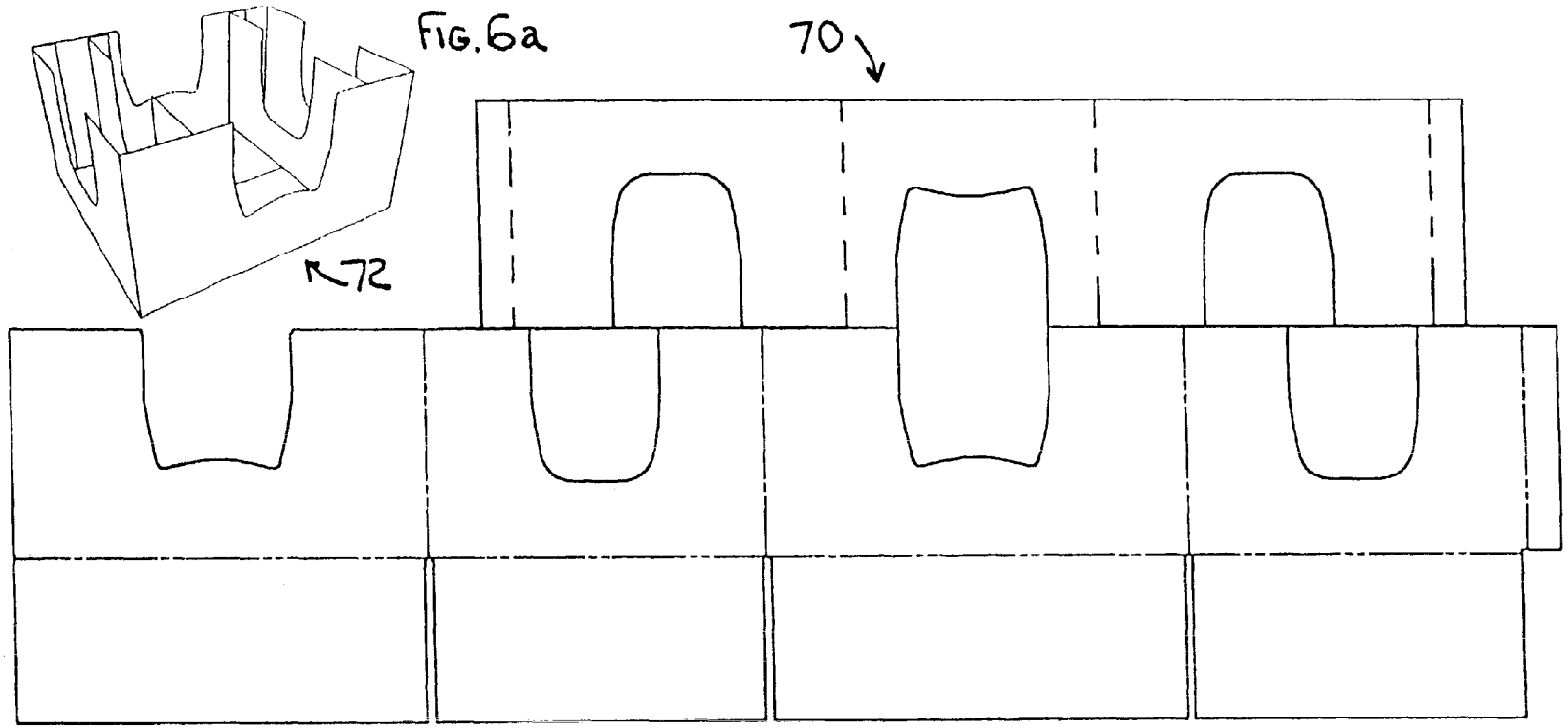
FIG. 6 is a plan view of a blank for a shipping and display container according to an alternative embodiment of the invention.
FIG. 6*a* is a perspective view of a shipping and display container according to the blank of FIG. 6.

FIG. 6 is a plan view of a blank 70 for shipping and display container 72 according to an alternative embodiment of the invention. FIG. 6*a* is a perspective view of shipping and display container 72 according to the blank 70 of FIG. 6, wherein access apertures are provided in the side and end walls and in the internal dividers.

Figures 7, 7A:
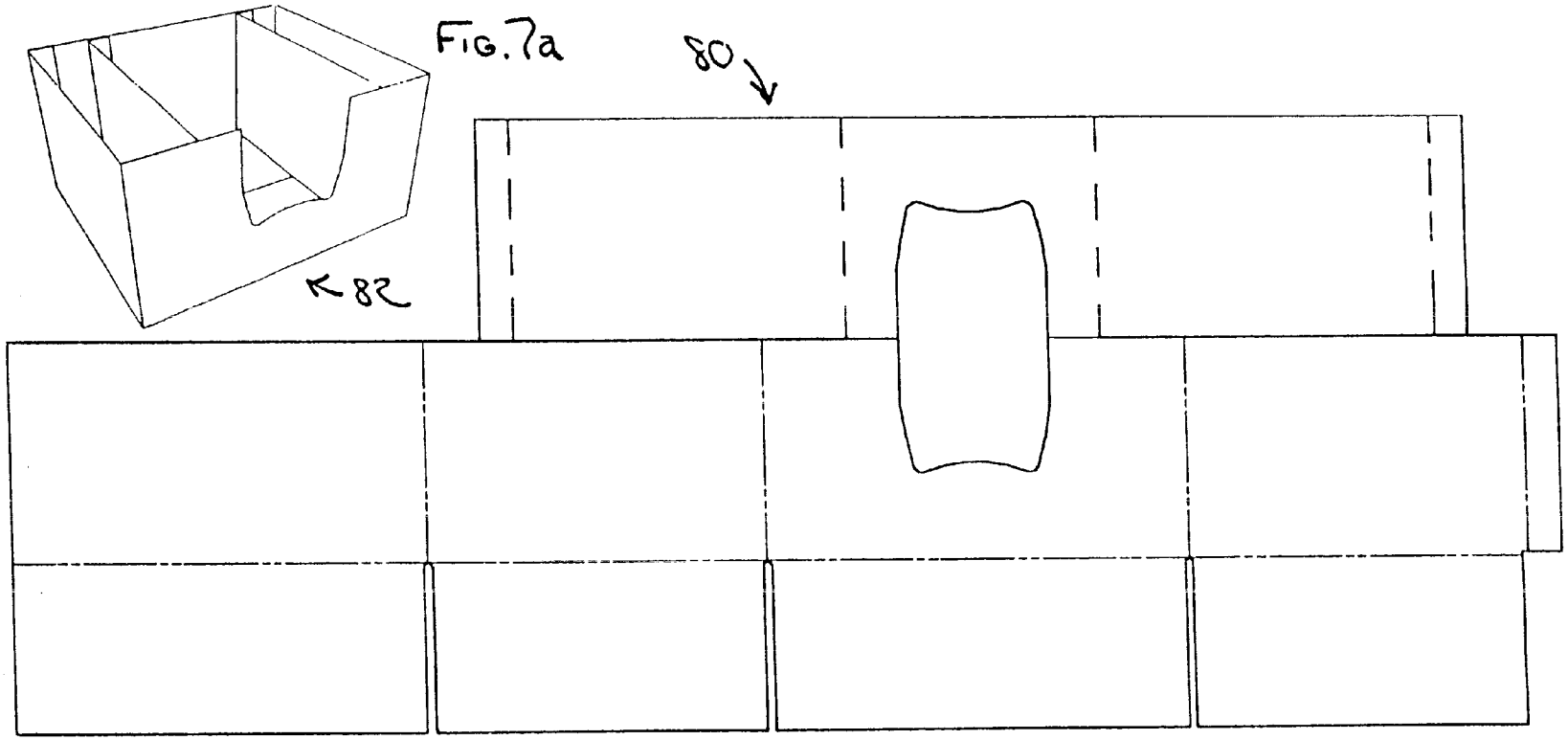
FIG. 7 is a plan view of a blank for a shipping and display container according to an alternative embodiment of the invention.
FIG. 7*a* is a perspective view of a shipping and display container according to the blank of FIG. 7.

FIG. 7 is a plan view of blank 80 for a shipping and display container 82 according to an alternative embodiment of the invention. FIG. 7*a* is a perspective view of shipping and display container 82 according to blank 82 of FIG. 7, wherein only the internal dividers have access apertures.

Figures 8, 8A:
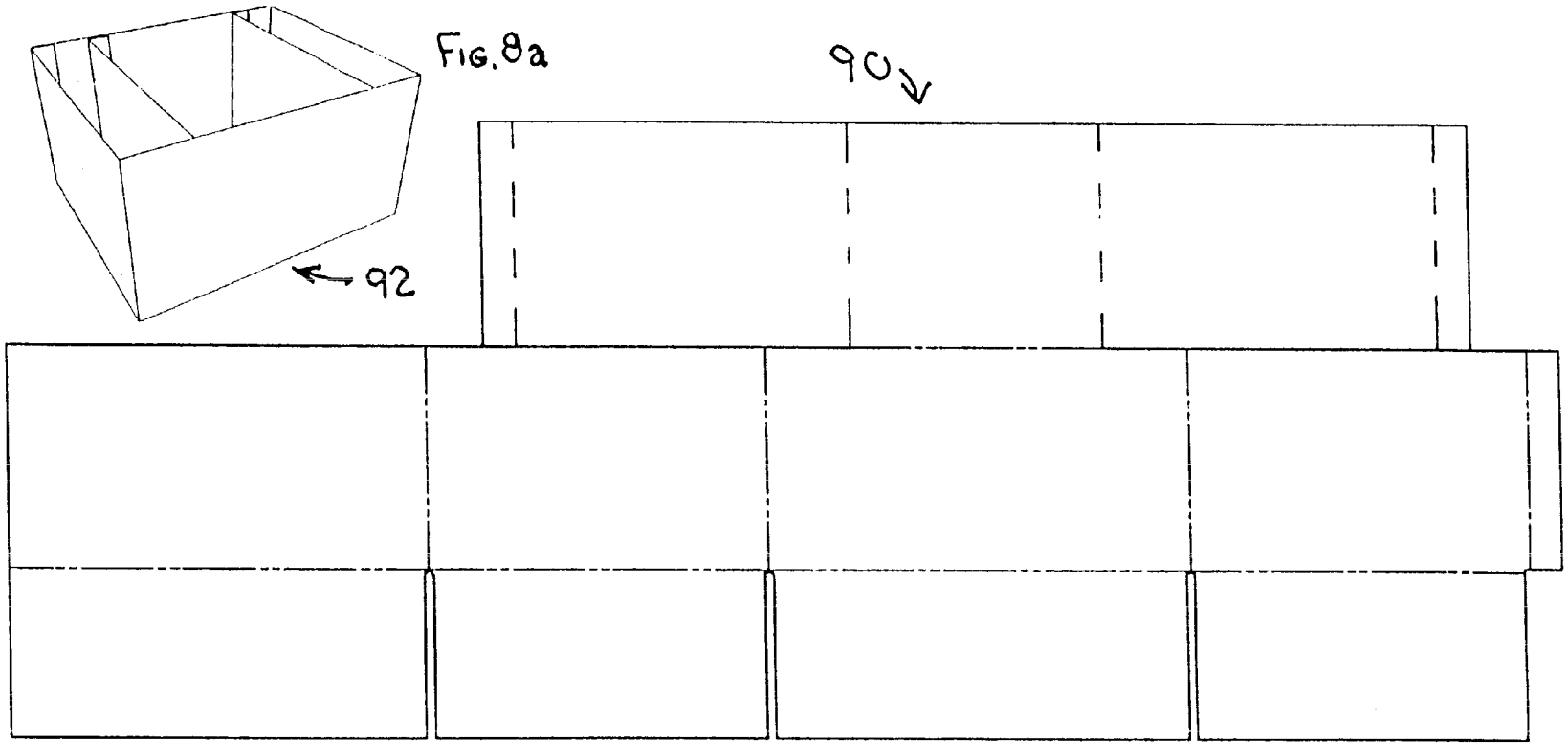
FIG. 8 is a plan view of a blank for a shipping and display container according to an alternative embodiment of the invention.
FIG. 8*a* is a perspective view of a shipping and display container according to the blank of FIG. 8.

FIG. 8 is a plan view of blank 90 for a shipping and display container 92 according to an alternative embodiment of the invention. FIG. 8*a* is a perspective view of shipping and display container 92 according to the blank 90 of FIG. 8, wherein no access apertures are provided.

The foregoing description and drawings merely explain and illustrate the invention, and the invention is not limited except insofar as the appended claims are so limited, as those skilled in the art who have the disclosure before them will be able to make modifications and variations therein without departing from the scope of the invention.

What is claimed is:

1. A shipping and display case for transporting and displaying product, which is operably configured to be articulated between a collapsed configuration and a shipping and display configuration, the shipping and display case having a selected overall height, the shipping and display case comprising:

first and second length wall panels, each having a top edge;

first and second width wall panels, each having a top edge and being foldably connected to the first and second length wall panels, respectively;

the first and second length wall panels being configured to be substantially perpendicular to the first and second width wall panels, when the shipping and display case is in its shipping and display configuration, and respective ones of the first and second length wall panels being configured to be substantially parallel to respective ones of the first and second width wall panels, when the shipping and display case is in its collapsed configuration;

a divider support panel, operably connected to the top edge of one of the first and second length wall panels and first and second width wall panels, the, divider support panel being operably positioned substantially between said one of said first and second length wall panels and first and second width wall panels, and the other of said first and second length wall panels and first and second width wall panels, the divider support panel having two ends;

two divider panels, each being foldably connected at a first end thereof to the respective end of the divider support panel, and foldably connected at second end thereof to said other of the first and second length wail panels and first and second width wall panels, the two divider panels being operably configured to extend substantially perpendicular to respective ones of the first and second length wall panels and first and second width wall panels, and substantially parallel to one another when the shipping and display case is in its shipping and display configuration, the two divider panels each having an overall height substantially equal to the selected overall height of the shipping and display case; and at least one bottom flap, operably connected to one of the first and second length wall panels and first and second width wall panels, and operably configured to be positioned substantially perpendicular to the first and second length wall panels and first and second width wall panels, when the shipping and display case is in its shipping and display configuration.

2. The shipping and display case according to claim 1, wherein the divider support panel is foldably connected to a top edge of said one of the first and second length wall panels, and is foldably positioned in juxtaposed, overlying relation to an inside surface of said one of said first and second length wall panels.

3. The shipping and display case according to claim 1, wherein the divider support panel is foldably connected to a top edge of said one of the first and second width wall panels, and is foldably positioned in juxtaposed, overlying relation to an inside surface of said one of said first and second width wall panels.

4. The shipping and display case according to claim 1, wherein the at least one divider panel comprises two divider panels, each divider panel foldably connected at a first end to the divider support panel, and foldably connected at a second end to the other of the first and second length wall panels and first and second width wall panels, the two divider panels being operably configured to extend substantially perpendicular between one of a set of first and second length wall panels and first and second width wall panels, when the shipping and display case is in its shipping and display configuration.

5. The shipping and display case according to claim 1, further comprising at least one access aperture disposed in at least one of the first and second length wall panels and first and second width wall panels.

6. The shipping and display case according to claim 1, wherein the height of the at least one divider panel is equal to the height of the first and second length wall panels and the height of the first and second width wall panels.

7. The shipping and display case according to claim 1, wherein the first and second length wall panels, first and second width wall panels, divider support panel, at least one divider panel, and at least one bottom flap are all monolithically formed from a single blank of case material.

8. The shipping and display case according to claim 7, wherein the single blank of case material is fabricated from at least one of the following materials: paper, paperboard, corrugated paperboard.

9. The shipping and display case according to claim 1, further comprising a divider attachment flap foldably connected to said second end of said at least one divider panel.

10. A blank for forming a shipping and display case having a selected overall height for transporting and displaying product, comprising:

a first length wall panel;

first and second width wall panels each of which is foldably connected to an opposite end edge region of the first length wall panel, respectively;

a second length wall panel, foldably connected to an end edge region of one of the first and second width wall panels opposite the end edge region of said first and second width wall panel attached to said first length wall panel;

a divider support panel, foldably connected to a top edge region of the first length wall panel, the divider support panel having two ends;

two divider panels, each being foldably connected at a first end thereof to the respective end of the divider support panel, the two divider panels extending substantially parallel to one another and each having an overall height substantially equal to the selected overall height of the case formed when the first and second length wall panels and first and second width wall panels are articulated to form a shipping and display case; and at least one bottom flap, foldably connected to an end edge region of one of the first and second length wall panels and first and second width wall panels.

11. A blank for forming a shipping and display case having a selected overall height for transporting and displaying product, comprising:

a first length wall panel;

first and second width wall panels, each of which is foldably connected to an opposite end edge region of the first length wall panel, respectively;

a second length wall panel, foldably connected to an end edge region of one of the first and second width wall panels opposite the end edge region of said first and second width wall panel attached to said first length wall panel;

a divider support panel, foldably connected to a top edge region of the first width wall panel, the divider support panel having two ends;

two divider panels, each being foldably connected at a first end thereof to the respective end of the divider support panel, the two divider panels extending substantially parallel to one another and each having an overall height substantially equal to the selected overall height of the case formed when the first and second length wall panels and first and second width wall panels are articulated to form a shipping and display case; and at least one bottom flap, foldably connected to a bottom edge region of one of the first and second length wall panels and first and second width wall panels.

12. The blank according to claim 10, wherein the blank is monolithically formed from a single blank of case material.

13. The blank according to claim 11, wherein the blank is monolithically formed from a single blank of case material.

14. The blank according to claim 12, wherein the single blank of case material is fabricated from at least one of the following materials: paper, paperboard, corrugated paperboard.

15. The blank according to claim 13, wherein the single blank of case material is fabricated from at least one of the following materials: paper, paperboard, corrugated paperboard.

* * * * *